United States Patent [19]

Fujimura et al.

[11] Patent Number: 4,686,933

[45] Date of Patent: Aug. 18, 1987

[54] MAGNETIC RECORDING IMAGE DEVELOPING APPARATUS

[75] Inventors: Yoshihiko Fujimura; Koichi Saitoh; Yuji Suemitsu, all of Kanagawa, Japan

[73] Assignee: Fuji Xerox Co., Ltd, Japan

[21] Appl. No.: 867,627

[22] Filed: May 27, 1986

Related U.S. Application Data

[63] Continuation of Ser. No. 590,003, Mar. 15, 1984, abandoned.

[30] Foreign Application Priority Data

Mar. 17, 1983 [JP] Japan ..... 58-43259

[51] Int. Cl.[4] ..... G03G 15/09

[52] U.S. Cl. ..... 118/623; 118/658

[58] Field of Search ..... 118/623, 658

[56] References Cited

U.S. PATENT DOCUMENTS 3,437,074 4/1969 Hagopian et al. ..... 118/623

3,858,514 1/1975 Beebe et al. ..... 427/47

4,391,842 7/1983 Huggins ..... 118/657 X 4,465,356 8/1984 Joseph et al. ..... 118/657 X

*Primary Examiner*—Bernard D. Pianalto

*Attorney, Agent, or Firm*—Finnegan, Henderson, Farabow, Garrett and Dunner

[57] ABSTRACT

An apparatus for developing a latent magnetic image on a moving magnetic recording medium in which the image is always satisfactorily developed without excess toner particles yet using a simple mechanism. A developing magnet extends parallel to the surface of the recording medium, which is in the form of a magnetic drum. The direction of the magnetic field produced by the magnet at the point (line) of closest approach of the recording medium and magnet is the same as the direction of the magnetic field at boundaries between background regions and recorded image regions on the magnetic recording medium. A nonmagnetic rotating sleeve is positioned around the development magnet, and magnetic toner supplied to the outer surface of the sleeve.

12 Claims, 8 Drawing Figures

MAGNETIC RECORDING IMAGE DEVELOPING APPARATUS

This application is a continuation of application Ser. No. 590,003, filed Mar. 15, 1984, now abandoned.

BACKGROUND OF THE INVENTION

The present invention relates to magnetic recording methods. More particularly, the invention relates to a method for rendering visible a latent magnetic image on a recording member which is uniformly magnetized in the direction of movement thereof except for image parts, which have the form of a dot pattern in which the magnetic field is reversed.

In such a magnetic recording method, first a magnetic latent image is formed on a magnetic medium by magnetization. The latent image is then developed with colored magnetic particles, specifically, with a magnetic toner composed of macromolecular resin and magnetic fine particles. The image thus developed is transferred onto a recording sheet using an electrostatic or magnetic method, and then fixed by the application of heat or pressure so as to obtain a permanent copy. Thereafter, residual magnetic toner is removed from the magnetic medium upon which the latent image was formed. The magnetic medium is then ready for use in the next developing cycle. When desired, the magnetic latent image can be erased from the magnetic medium and a new magnetic latent image formed thereon.

There have been proposed a variety of magnetic latent image forming methods for use in magnetic recording. In one of the conventional methods, the magnetizable magnetic medium is made of a thermomagnetic materal such as $CrO_2$ whose Curie temperature is relatively close to room temperature. In accordance with this method, while a thermal image in the form of a pattern of dots is imposed on the recording medium by means of a thermal head or laser beam, an external magnetic field is applied to the recording medium. A magnetic latent image is thus formed on the recording medium through thermoremanent magnetism by the cooperation of the heat and magnetic field. With this method, the thermomagnetic material is magnetized in advance uniformly in one direction, specifically, the direction of movement of the recording medium, and the external magnetic field is applied in such a manner that the direction of magnetization is reversed by the thermal input section.

For this method, it is possible to use a thermal head having heat generating elements in a number sufficient to provide a desired picture element density, or a laser optical system which inputs a thermal image, in a non-contact manner, with a high density. This method is superior to a magnetic latent image forming method using a magnetic head in that the density of the magnetic latent image which is formed is high. Also, the manufacturing cost for the apparatus is lower.

In a magnetic latent image formed using a thermal head, as shown in FIG. 1, the background is magnetized uniformly in advance in one direction, and the magnetization is reversed, in a dot pattern, only in areas which are heated. Magnetic toner particles adhere to the areas where the field is reversed to produce a visible image.

In this system, unlike an electrostatic latent image developing process, it is unnecessary to charge the toner particles. Therefore, a single component magnetic toner which is stable against environmental changes and which has a long shelf life should be employed as the developing agent.

Methods for developing an electrostatic latent image using a single component magnetic toner are well known. In a device for practicing this method, a latent image is supplied toner from a magnetic "brush", which is a magnetic roll onto which magnetic toner is magnetically attracted, to obtain a visible image. The resultant image is high in quality and the mechanism is simple. However, it is not suitable to use a conventional electrostatic latent image developing device as a magnetic latent image developing device because, in the electrostatic latent image developing method, in order to prevent the background from fogging, a high magnetic field must be applied, several hundred to one thousand gauss or more. However, the coercive force of a magnetic medium employed in the magnetic recording method is on the order of about 1,000 Oe. Accordingly, if a magnetic field sufficiently strong to prevent fogging is applied, the recording medium is demagnetized, that is, the latent image is eradicated, as a result of which the resultant picture is unsatisfactory. Furthermore, repetitive use of the latent image, which is a specific feature of the magnetic copying method, cannot be carried out.

If the magnetic field in the developing section formed by the magnetic roll is sufficiently reduced, the latent image can be prevented from being eradicated. However, if the magnetic force of the magnetic roll is reduced, sufficient magnetic toner cannot be conveyed, as a result of which the latent image is not satisfactorily developed. Furthermore, since the magnetic field of the magnetic roll in the developing section interferes with the magnetic field of the latent image, the magnetic toner tends to stick too firmly to some of the dot areas of the recording medium, and accordingly not transfer completely to the recording sheet. This is another cause of unsatisfactory development.

SUMMARY OF THE INVENTION

Overcoming the drawbacks of the prior art, the invention provides a magnetic recording method in which a magnetic roll having a low magnetic force is used so as not to eradicate a magnetic latent image. With the invention, not only is magnetic toner satisfactorily conveyed on the roll, but also the latent image is uniformly developed.

More specifically, the invention provides an apparatus for developing a latent magnetic image on a moving magnetic recording medium including a developing magnet, a nonmagnetic sleeve positioned around the developing magnet, and a supply of magnetic toner particles. The developing magnet is positioned adjacent the recording medium, extending perpendicular to the direction of movement of the recording medium. The direction of the magnetic field produced by the developing magnet at a point (line) of closest approach of the recording medium and developing magnet is in the same direction as the magnetic field at boundaries between the background regions and the recorded image regions (dots) on the magnetic recording medium. Preferably, the magnetic force produced by the developing magnet in a gap between the outer surface of the rotating nonmagnetic sleeve and the recording medium is one-fourth or less of the residual saturization magnetization of the recording medium. The speed of the outer surface of the sleeve should be in a range of one-half to one-tenth the speed of the recording medium in the direction of movement of the recording medium. The recording medium and the sleeve may be rotated in opposite directions so that the directions of movement at the gap between the outer surface of the sleeve and the recording medium are the same.

A doctor blade can be provided for regulating the thickness of the layer of toner taken up by the rotating nonmagnetic sleeve. The distance between the doctoring edge of the doctor blade and the surface of the sleeve should be equal to or greater than about 0.5 mm. Further, the ratio of the distance between the edge of the doctor blade and the surface of the sleeve to the width of the gap is preferably in a range of 0.5 to 1.0. The developing magnet may be composed of a plurality of alternating poles, with a one of the poles which is most closely adjacent the recording medium having a lower magnetic force than other ones of the poles. Preferably, the ratio of the magnetic force of the one of the poles closest to the recording medium to the magnetic force of the other ones of the poles is in a range of 0.2 to 0.4.

DESCRIPTION OF THE PREFERRED EMBODIMENTS

The invention will now be described in detail with reference to the accompanying drawings.

Figure 1:
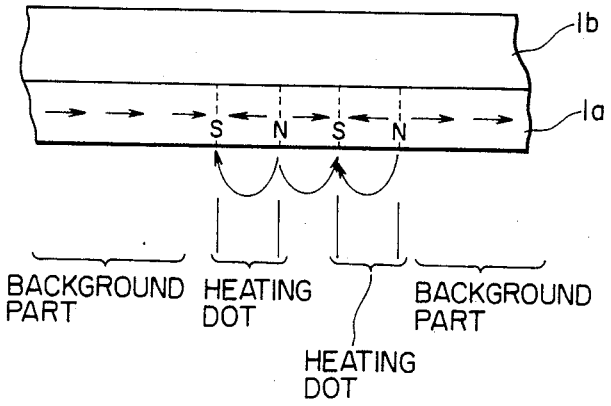
FIG. 1 is an explanatory diagram of a magnetic record and a magnetic latent image employed in a magnetic recording method according to the invention.
Figure 2:
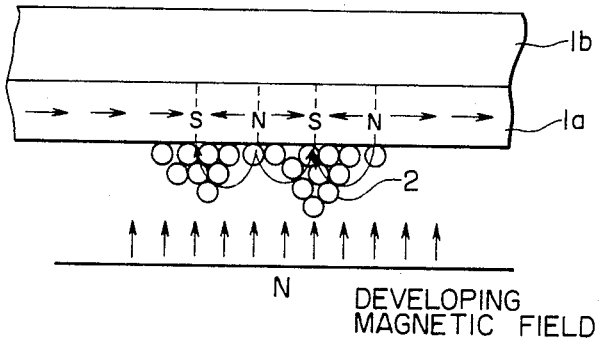
FIG. 2 is an explanatory diagram depicting interference of the magnetic field of a latent image and a developing magnetic field.

In order to protect a latent image on a magnetic recording member from eradication, the developing magnetic field of a magnetic roll should be at the maximum half of the coercive force of the magnetic layer of the recording member, about 400 Oe in the case where the recording member is made of $CrO_2$. However, the inventors have found that, even if the magnetic field is not so strong as to eradicate the latent image, due to interference from the leakage magnetic field of the magnetic latent image and the developing magnetic field of the magnetic roll, magnetic toner particles tend to he displaced from the latent image, as a result of which the developed image is irregular or not sharp. This is due to the fact that the attractive force is strong where the direction of the leakage magnetic field of the latent image is the same as that of the developing magnetic field, as shown in FIG. 2, and it is weak where the direction of the leakage magnetic field of the latent image is opposite to that of the developing magnetic field. When the leakage magnetic field of the latent image is stronger than the developing magnetic field, no attractive force is present where the direction of the leakage magnetic field of the latent image is opposite to that of the developing magnetic field.

In order to prevent the formation of regions where there is no attractive force, it is desirable that the developing magnetic field be less than one-fourth of the residual saturation magnetization. For instance, it should be less than 200 Oe in the case of anisotropic magnetization of $CrO_2$ and less than 100 Oe in the case of isotropic magnetization of $CrO_2$. However, developing a latent image with a developing roll having a low developing magnetic field is disadvantageous in that toner particles tend to stick to the rear part of a magnetic image (as viewed in the direction of advancement of the recording member), while the front part of the magnetic image is not developed.

The inventors have found that, in order to prevent the above-described irregular or unsatisfactory development and to develop image-forming dots with high fidelity, a speed difference should be provided between the periphery of the recording member and the surface of a nonmagnetic sleeve surrounding the magnetic roll. Further, the developing magnetic field intensity should be selected so that a strong attractive force acts on the forward part of the image being developed.

An important feature of a magnetic recording method according to the invention is that the developing magnet is fixed so that the direction of the magnetic field of the developing magnet is the same as the direction of the magnetic field at boundaries, on the side as viewed in the direction of movement of the magnetic recording member, between image parts and background parts of the magnetic recording member. The nonmagnetic sleeve is turned so that the magnetic latent image is developed with magnetic toner.

Figure 3A:
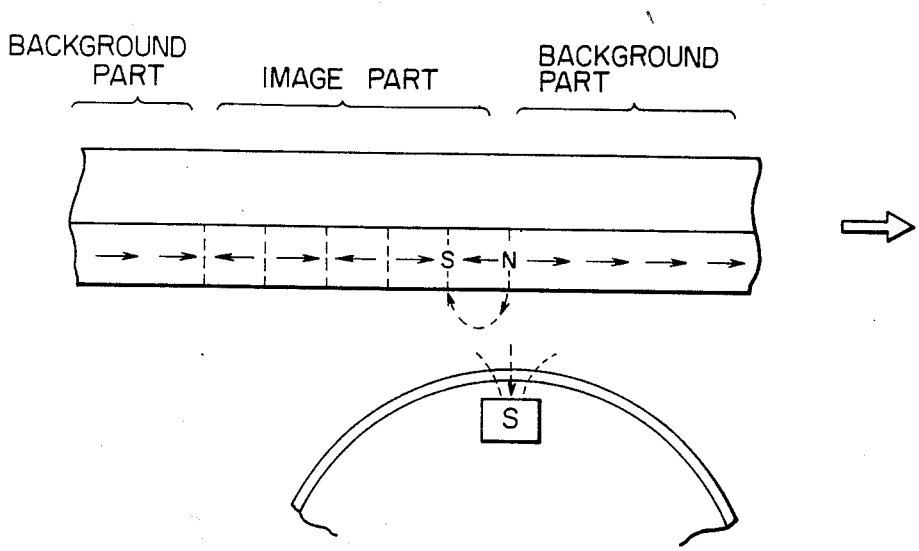
FIGS. 3A through 3D are explanatory diagrams showing the relations between the magnetization patterns of magnetic layers and developing magnets.
Figure 3B:
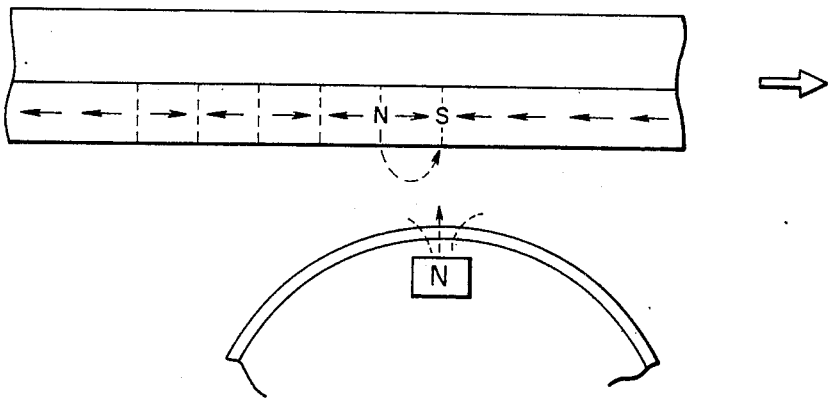

The relations between the direction of the magnetic field in a magnetic latent image on a magnetic recording member and the direction of the magnetic field of a developing magnet used in the invention are as shown in the FIGS. 3A to 3D. More specifically, FIGS. 3A and 3B illustrate the case of uniform planar magnetization of a background part. In FIG. 3A, a N pole occurs at the boundary, on the right side as viewed in the direction of movement of the recording member, between an image part and a background part of a latent image on the magnetic recording member. In this case, the magnetic field of the developing magnet, which is the same in direction as the magnetic field of the N pole, is an S pole. In FIG. 35, the direction of the uniform magnetization of the background part is opposite that shown in FIG. 3B. Therefore, in the case of FIG. 3B, a S pole occurs at the boundary, on the right side in the direction of movement of the recording member, between an image part and a background part of a latent image on the magnetic recording member, in which case the magnetic field of the developing magnet is an N pole.

Figure 3C:
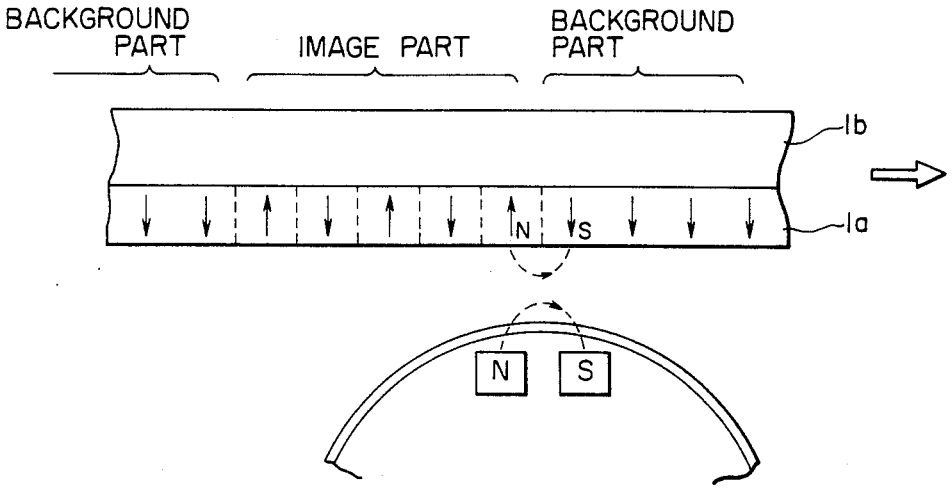
Figure 3D:
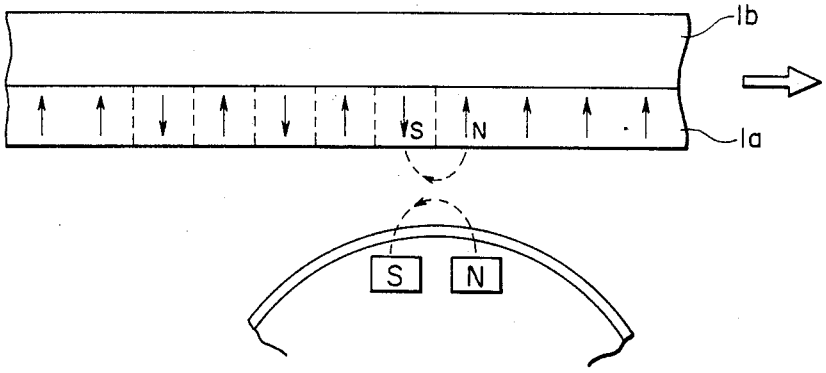

FIGS. 3C and 3D show the case where the background part is uniformly magnetized in the vertical (perpendicular) direction. In FIG. 3C, the direction of the magnetic field at the boundary, on the side as viewed in the direction of movement of the magnetic recording member, between an image part and a background part of a latent image on the recording member is the same as the direction of movement of the recording member. Therefore, in order to make the direction of the developing magnetic field the same, two developing magnets (fixed magnets) are arranged in such a manner that the magnet on the right side, as viewed in the direction of movement of the recording member, is an S pole. In FIG. 3D, the direction of magnetization of a background part is opposite to that in the case of FIG. 3C. Therefore, in order for the direction of the magnetic field at the boundary on the right side, as viewed in the direction of movement of the magnetic recording member, between an image part and a background part of a latent image to be the same as that of the developing magnetic field, two fixed magnets are arranged oppositely to those in the case of FIG. 3C.

Figure 4:
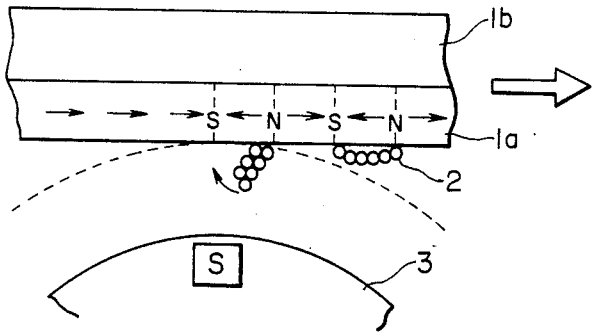
FIG. 4 is an explanatory diagram for a description of the principle of the magnetic recording method of the invention.

A development operation in accordance with the invention will he described in detail with reference to FIG. 3A by way of example. In the case where the recording member is moved in the left-to-right direction with respect to the magnetic brush, magnetic dot areas can be uniformly developed by first allowing magnetic toner particles to adhere to the right ends of the dot areas. The toner which has been firmly stuck to the right ends of the dot areas is rubbed by the magnetic brush because the speed of the recording member is different from that of the magnetic brush. If the relative speed is set so that a toner chain stuck to the recording member is inclined in a direction opposite to the direction of movement of the recording member, the toner chain will be pushed in the right-to-left direction as shown in FIG. 4 and uniform development will be achieved.

On the other hand, for a low magnetic force magnetic roll in which the main developing pole has one-fourth or less of the residual saturation magnetization of the magnetic recording member, the speed of rotation of the roll should be low compared with an electrostatic latent image developing unit or the like. The reason for this is that, since the magnetic field of the developing section must be relatively weak as described above, if the roll were turned at high speed, the centrifugal force exerted on the magnetic toner could not be overcome by the magnetic attraction force, and hence the toner would be spun off the roll.

If the recording member and the sleeve are rotated in opposite directions, or if the recording member and the sleeve are rotated in the same direction at the nip region and the speed of the sleeve is significantly higher than that of the recording member, because the force retaining magnetic toner on the roll at the nip region of the drum and the roll is small, a pool of magnetic toner is liable to be formed at the entrance of the nip region. This is not acceptable. However, if the speed of the recording member is made higher than the speed of the sleeve in the case where the recording member and the sleeve are moved in the same direction, toner can be satisfactorily conveyed with a low magnetic force magnetic roll described above.

Figure 5:
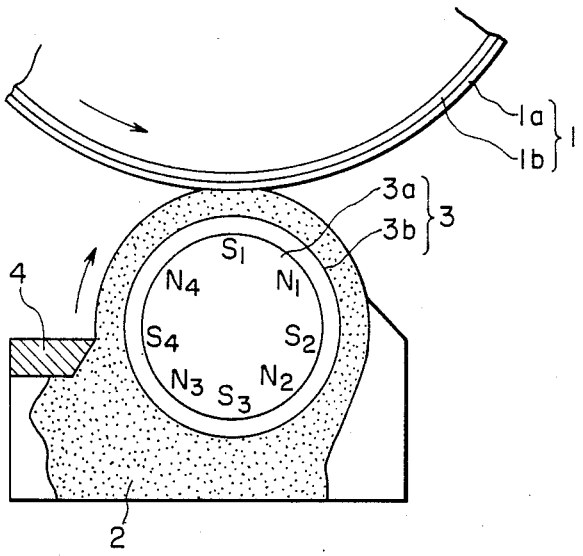
FIG. 5 is a sectional view showing the arrangement of a developing unit constructed in accordance with the invention.

The invention will now be described further with reference to a specific preferred embodiment thereof. FIG. 5 is a sectional view outlining an example of a developing unit according to the invention. In FIG. 5, reference numeral 1 designates a magnetic recording member. The recording member 1 is composed of a base 1*b* and a magnetic layer 1*a* formed on the base 1*b*. The magnetic layer 1*a* has a reversal magnetization pattern corresponding to a dot image. The front end, in the direction of movement of the recording member 1, of a dot appears as an N pole. The magnetic recording member is a drum-shaped member prepared by forming a magnetic layer on a cylindrical base. However, it should be noted that the invention is not limited thereto or thereby. That is, the recording member may be a belt-shaped magnetic recording member made of a flexible sheet and a magnetic layer formed thereon.

As seen in FIG. 5, the magnetic member 1 is turned counterclockwise. Further in FIG. 5, reference numeral 3 designates a magnetic roll made of a rotatably supported sleeve 3*b* inside of which a number of magnets 3*a* are fixedly provided. A gap of predetermined width is provided between the recording member and the magnetic roll. The magnetic roll confronts the recording member through one (S1) of the poles which has a weak magnetic force, 200 Oe or less. The other poles should not be so weak in order to hold and convey the toner. It is preferable that they have a magnetic force on the order of 500 to 1000 Oe. In the above-described embodiment, the magnetization pattern of the magnetic roll is an eight-pole symmetrical pattern. However, the invention is not limited thereto or thereby.

The sleeve of the magnet roll is turned clockwise in FIG. 5 at a speed lower than that of the recording medium. The speed of rotation of the sleeve should be such that magnetic toner can be sufficiently supplied to the nip region for development. A speed on the order of one-half to one-tenth the speed of the recording member is sufficient.

Further in FIG. 5, reference numeral 4 designates a doctor blade for regulating the thickness of the toner layer. The doctor blade 4 is positioned so that a predetermined distance t is maintained between the blade and the sleeve. The amount of toner supplied to the sleeve, and hence to the nip region, can be controlled by adjusting the distance t. The distance t should be determined in consideration of the clearance d between the drum and the sleeve. If the distance t is excessively short, the gap between the doctor blade 4 and sleeve 3*b* will tend to be clogged up by foreign matter such as dust, thread particles, or large toner particles, as a result of which the developed image may be streaky.

As a result of research conducted by the inventors, it has been found that preferably the distance t is 0.5 mm or more, and that the ratio of t to d satisfies $1.0 \geqq t/d \geqq 0.5$. By setting the ratio t/d in this range, development will be satisfactorily achieved with a sufficiently high density without excessive amounts of toner being supplied to the nip region.

Experiments were carried out with a developing unit constructed as described above. A magnetic latent image was formed with heated dots 125 μm in diameter, the front ends of which, as viewed in the direction of movement, were N poles. The latent image was developed with a peripheral speed of the sleeve of 100 m/s using an eight-pole magnet structure made up of a developing magnetic pole, which was a S pole having a magnetic force of 60 Oe, and seven poles having magnetic forces of 500 to 800 Oe. In this case $t=1.5$ mm and $d=2$ mm. The developed image was uniform in density and both solid image portions and line image portions had quite high fidelity.

Experiments similar to that described above were carried out with a magnetic roll in which the developing main pole was a N pole having a magnetic force of 60 Oe. In the developed image, solid image portions and line image portions were similar in density to those mentioned above, however, they did not have the same degree of fidelity as in the former case. This was due to the fact that excessive amounts of toner adhered to peripheries of the dots in the developed image.

As is clear from the above description, according to the invention, a magnetic latent image on a magnetic recording member can be developed with high fidelity. Moreover, a developing unit employing the magnetic recording method according to the invention has a simpler construction and higher reliability than a conventional electrostatic latent image developing unit.

We claim:

1. An apparatus for developing a latent magnetic image on a moving magnetic recording medium, comprising:

a moving magnetic recording medium having a uniformly magnetized background and reversal magnetized image regions;

a developing magnet positioned adjacent said magnetic recording medium, the magnetic field produced by said developing magnet at the point of closest approach to said magnetic recording medium being the same direction as the magnetic field at the leading edge boundary between the background regions and the image regions on said magnetic recording medium in the direction of movement of said magnetic recording medium;

a rotating nonmagnetic sleeve positioned around said developing magnet with a gap between an outer surface of said sleeve and said magnetic recording medium; and means for supplying magnetic toner to said sleeve.

2. The apparatus of claim 1, wherein the magnetic force produced by said developing magnet in said gap is less than one-fourth a residual saturization magnetization of said recording medium.

3. The appatatus of claim 1, wherein the speed of said outer surface of said sleeve is in a range of one-half to one-tenth of the speed of said recording medium in said direction of movement of said recording medium.

4. The apparatus of claim 3, wherein said recording medium and said sleeve are rotated in opposite directions.

5. The apparatus of claim 1, further comprising a doctor blade for regulating a thickness of toner particles taken up by said sleeve.

6. The apparatus of claim 5, wherein a distance between an edge of said doctor blade and said surface of said sleeve is equal to or greater than 0.5 mm.

7. The apparatus of claim 5, wherein the ratio of the distance between an edge of said doctor blade and said surface of said sleeve to the width of said gap is in a range of 0.5 to 1.0.

8. The apparatus of claim 1, wherein said developing magnet comprises a plurality of alternating poles, the pole most closely adjacent said recording medium having a lower magnetic force than the other poles.

9. The apparatus of claim 8, wherein a ratio of said magnetic force of said pole closest to said recording medium to said magnetic force of said the other poles is in a range of 0.2 to 0.4.

10. A method for developing a latent magnetic image on a moving magnetic recording medium, comprising:

providing a moving magnetic recording medium having uniformly magnetized background and reversal magnetized image regions; and providing a developing magnet adjacent said magnetic recording medium so that the magnetic field produced by the developing magnet at the point of closest approach to the magnetic recording medium is in the same direction as the magnetic field of the leading edge boundary between background regions and image regions on the magnetic recording medium in the direction of movement of the magnetic recording medium.

11. An apparatus for developing a latent magnetic image on a moving magnetic recording medium, comprising:

a moving magnetic recording medium having a uniformly magnetized background and reversal magnetized image regions;

a developing magnet positioned adjacent said magnetic recording medium, the magnetic field produced by said developing magnet at the point of closest approach to said magnetic recording medium being the same direction as the magnetic field at the leading edge boundary between the background regions and the image regions on said magnetic recording medium in the direction of movement of said magnetic recording medium;

a rotating nonmagnetic sleeve positioned around said developing magnet with a gap between an outer surface of said sleeve and said magnetic recording medium;

means for supplying magnetic toner to said sleeve so that the toner forms a magnetic brush on the surface of the nonmagnetic sleeve and a toner chain extending from the magnetic recording medium; and means for inclining the extending toner chain in a direction opposite the direction of movement of the magnetic recording medium by maintaining a difference in the speed of movement of the magnetic brush and the magnetic recording medium.

12. An apparatus for developing a latent magnetic image on a moving magnetic recording medium, comprising:

a moving magnetic recording medium having a uniformly magnetized background and reversal magnetized image regions;

a developing magnet positioned adjacent said magnetic recording medium, the magnetic field produced by said developing magnet at the point of closest approach to said magnetic recording leading medium being the same direction as the magnetic field at the leading edge boundary between the background regions and the image regions on said magnetic recording medium in the direction of movement of said magnetic recording medium;

a rotating nonmagnetic sleeve positioned around said developing magnet with a gap between an outer surface of said sleeve and said magnetic recording medium;

means for supplying magnetic toner to said sleeve so that the toner forms a magnetic brush on the surface of the nonmagnetic sleeve and a toner chain extending from said leading edge boundary of the magnetic recording medium; and means for inclining the extending toner chain in a direction opposite the direction of movement of the magnetic recording medium by maintaining a difference in the speed of movement of the magnetic brush and the magnetic recording medium.

* * * * *